US009850015B2

(12) United States Patent
Hayashi et al.

(10) Patent No.: US 9,850,015 B2
(45) Date of Patent: Dec. 26, 2017

(54) CONTINUOUS ROTARY TYPE FILLING AND PACKING MACHINE PROVIDED WITH PRINTING MECHANISM

(75) Inventors: Kouji Hayashi, Tokyo (JP); Tomoyuki Masuda, Tokyo (JP); Tadashi Mifune, Itano-gun (JP); Mitsuhiro Nishitani, Itano-gun (JP)

(73) Assignees: KABUSHIKI KAISHA YAKULT HONSHA, Tokyo (JP); SHIKOKU KAKOKI CO., LTD., Tokushima (JP)

( * ) Notice: Subject to any disclaimer, the term of this patent is extended or adjusted under 35 U.S.C. 154(b) by 899 days.

(21) Appl. No.: 13/578,079

(22) PCT Filed: Feb. 10, 2011

(86) PCT No.: PCT/JP2011/000740

§ 371 (c)(1),
(2), (4) Date: Oct. 4, 2012

(87) PCT Pub. No.: WO2011/102098

PCT Pub. Date: Aug. 25, 2011

(65) Prior Publication Data

US 2013/0042575 A1 Feb. 21, 2013

(30) Foreign Application Priority Data

Feb. 16, 2010 (JP) ..... 2010-031025

(51) Int. Cl.
*B65B 1/00* (2006.01)
*B65B 61/26* (2006.01)
(Continued)

(52) U.S. Cl.
CPC ..... *B65B 61/26* (2013.01); *B41J 2/2114* (2013.01); *B41J 3/4073* (2013.01); *B65B 7/285* (2013.01);
(Continued)

(58) Field of Classification Search
None
See application file for complete search history.

(56) References Cited

U.S. PATENT DOCUMENTS 2,639,850 A * 5/1953 Zimmermann ..... B67B 3/00 101/4
4,370,925 A * 2/1983 Kazumi ..... B41F 17/22 101/40
(Continued)

FOREIGN PATENT DOCUMENTS

EP 0929474 * 8/2001 ..... B65D 85/00
EP 1410988 A1 4/2004
(Continued)

OTHER PUBLICATIONS

International Search Report of PCT/JP2011/000740, dated May 17, 2011.
(Continued)

*Primary Examiner* — Hemant M Desai
*Assistant Examiner* — Mobeen Ahmed
(74) *Attorney, Agent, or Firm* — Westerman, Hattori, Daniels & Adrian, LLP

(57) ABSTRACT

A high-speed continuous rotary type filling and packaging machine can identifies a defective filling head and a defective seal head and it also identify which part of a seal working surface in the seal head has a defect. In a sealing device of the high-seed continuous rotary type filling and packaging machine that covers a container body, which is filled with liquid contents, with a molded lid and seals the container body and the molded lid to produce a sealed container, a filling head number and a seal head number are inkjet-printed, desirably transparent ink, which can be read by irradiation of an ultraviolet ray, on a container body in which a seal working surface in the seal head and the top surface of the container molded lid are brought into press-
(Continued)

contact and a positional relation between a seal working surface and the sealed container is fixed.

7 Claims, 3 Drawing Sheets

(51) Int. Cl.

| | |
|---|---|
| ***B65B 57/04*** | (2006.01) |
| ***B65B 57/02*** | (2006.01) |
| ***B41J 2/21*** | (2006.01) |
| ***B41J 3/407*** | (2006.01) |
| ***B65B 7/28*** | (2006.01) |
| ***B65B 51/22*** | (2006.01) |

(52) U.S. Cl.
CPC ..... *B65B 7/2878* (2013.01); *B65B 51/225* (2013.01); *B65B 57/02* (2013.01); *B65B 57/04* (2013.01)

(56) References Cited

U.S. PATENT DOCUMENTS

| | | | | | |
|---|---|---|---|---|---|
| 4,691,496 | A * | 9/1987 | Anderson | B65B 57/10 | 141/144 |
| 5,048,870 | A * | 9/1991 | Mangini | G09F 3/0288 | 206/232 |
| 5,371,996 | A * | 12/1994 | Ueda | B65B 7/164 | 53/298 |
| 6,681,935 | B1 * | 1/2004 | Lewis | A61J 1/035 | 206/534 |
| 2003/0107632 | A1 * | 6/2003 | Arita | C09D 11/324 | 347/100 |
| 2007/0051073 | A1 * | 3/2007 | Kelley | B65B 21/12 | 53/440 |
| 2009/0212060 | A1 * | 8/2009 | Shinohara | B65B 7/285 | 220/661 |
| 2010/0192517 | A1 * | 8/2010 | Schach | B41J 2/0057 | 53/411 |
| 2011/0167760 | A1 * | 7/2011 | Spix | B65B 5/105 | 53/65 |

FOREIGN PATENT DOCUMENTS

| | | | | |
|---|---|---|---|---|
| EP | 1759996 | * | 7/2007 | B65B 47/04 |
| JP | 49-37977 | B | 10/1974 | |
| JP | 11-115919 | A | 4/1999 | |
| JP | 2000-109189 | A | 4/2000 | |
| JP | 2000-219294 | A | 8/2000 | |
| JP | 2002-166996 | A | 6/2002 | |
| JP | 2005-343507 | A | 12/2005 | |
| JP | 2902768 | A1 | 12/2007 | |
| JP | 4258873 | B2 | 4/2009 | |
| WO | 97/24278 | A1 | 7/1997 | |

OTHER PUBLICATIONS

Extended European Search Report dated Jan. 2, 2014, issued in European application No. 11744392.9.

Notification of Transmittal of Translation of the International Preliminary Report on Patentability (Form PCT/IB/338) of International Patent Application No. PCT/JP2011/000740, dated Sep. 27, 2012, with Forms PCT/IB/373 and PCT/ISA/237.

* cited by examiner

[Figure 1]
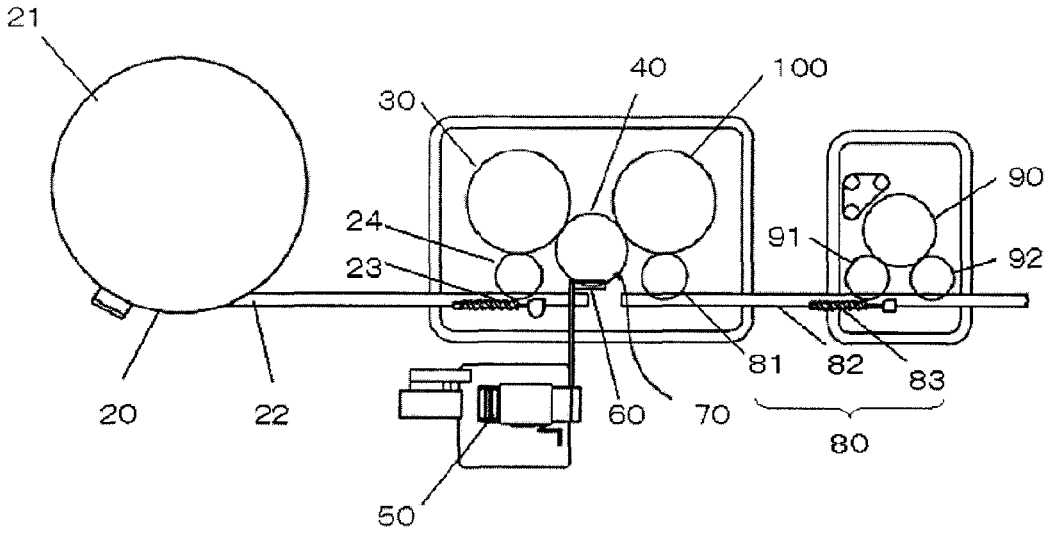
[Figure 2]
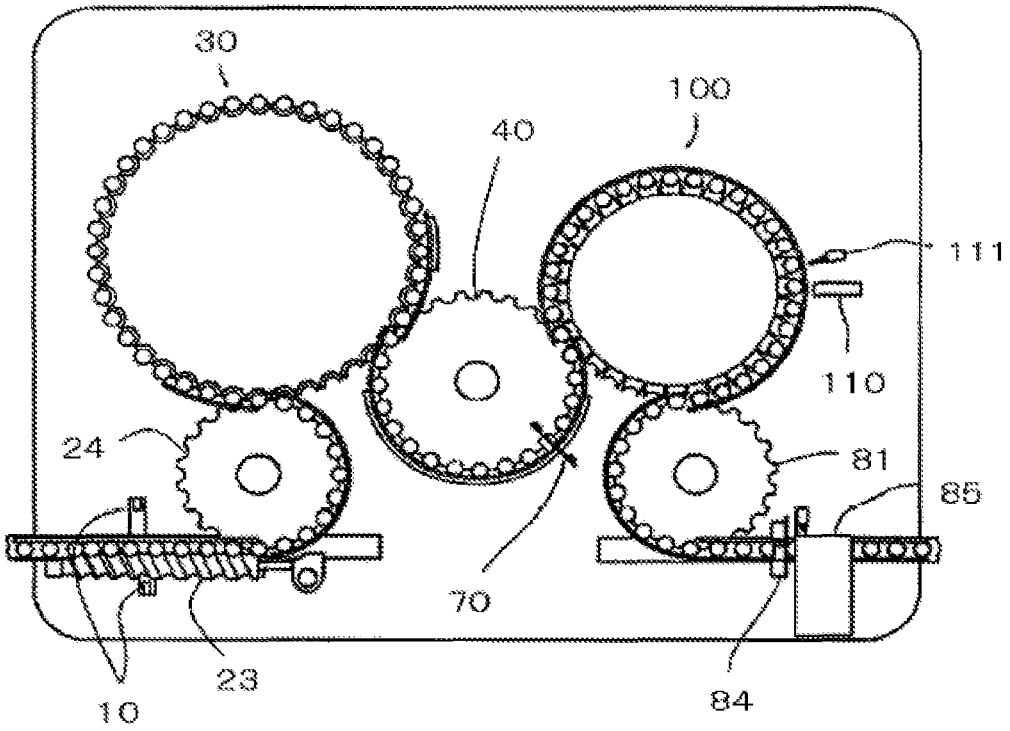

[Figure 3]
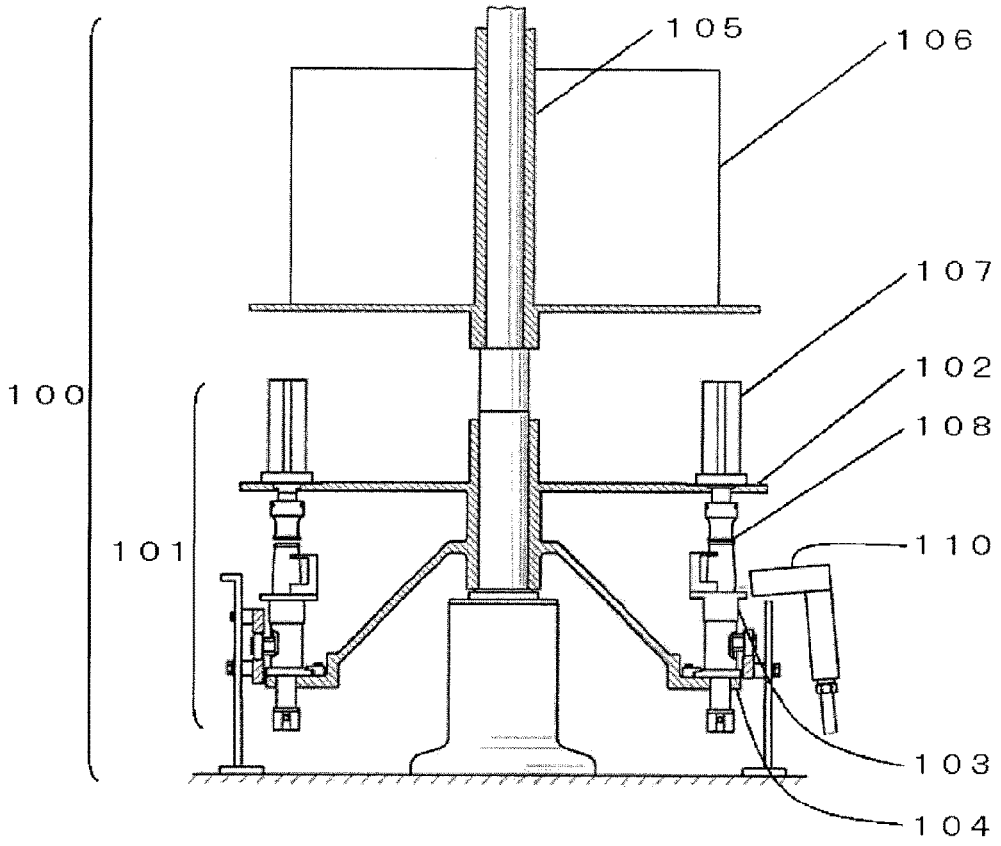

[Figure 4]
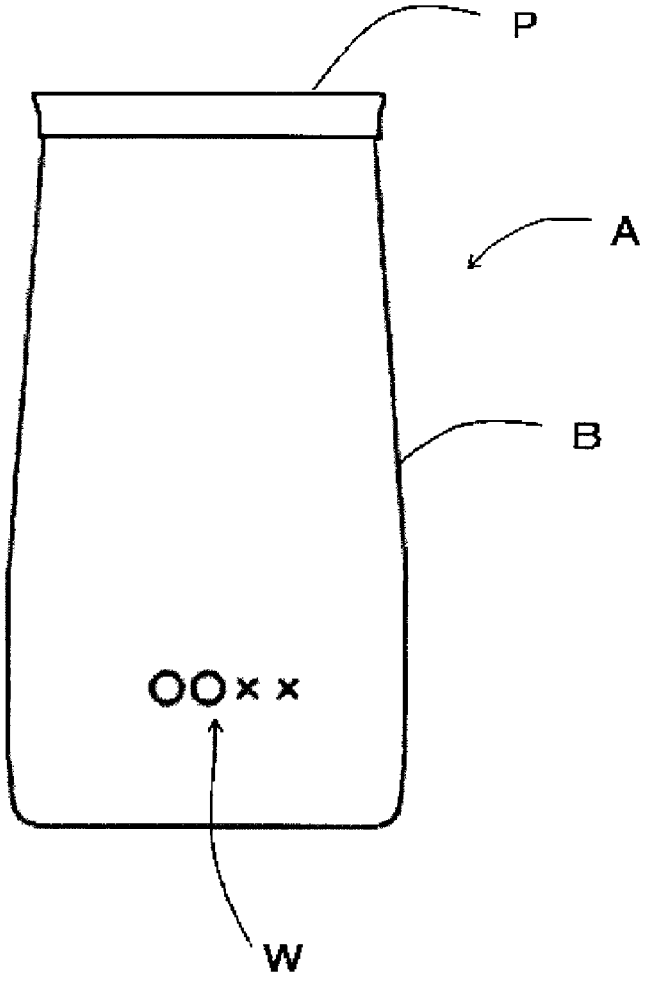

CONTINUOUS ROTARY TYPE FILLING AND PACKING MACHINE PROVIDED WITH PRINTING MECHANISM

TECHNICAL FIELD

The present invention relates to a continuous rotary type filling and packaging machine provided with a printing mechanism and, more particularly, to a continuous rotary type filling and packaging machine equipped with a quality management function for a filling device and a sealing device, the continuous rotary type filling and packaging machine including a printing machine that, in order to support detection and discharge of a defective sealed product, when a molded lid on a container body and a seal working surface of a seal head are in a press-contact state in the sealing device, prints on a side circumferential surface of a container, desirably prints invisible ink on the side circumferential surface to thereby print a filling head number and a seal head number on the side circumferential surface of the container.

BACKGROUND ART

As a known conventional filling and packaging machine of this type, there is known a continuous rotary type filling and packaging machine provided with a container vertically adjusting device that vertically adjusts bottomed cylindrical container bodies made of synthetic resin, which are supplied in arbitrary orientations, such that upper end openings thereof face up and supplies the container bodies to a subsequent process, a filling device that fills a container supplied from the container vertically adjusting device with contents, a lid supplying device that covers the upper end opening of the container, which is filled with the contents, with a lid substantially C-shaped in cross section, and a sealing device that heats the lid and seals the upper end opening of the container with the lid (see for example, Patent Documents 1 and 2).

With a conventional continuous rotary type filling and packaging machine not including a measuring function in a filling head itself, a sufficient filling amount result with respect to a filling target value cannot be obtained. Even if products are measured after the end of filling and a defective product is detected, a filling head number cannot be identified among plural filling heads in a filling device from the defective product. As a result, all the filling heads in the filling device are inspected and a long inspection time is required. Besides the problem concerning a filling amount, in a mechanism without a self diagnosis function in a heating device in the case of occurrence of a seal failure (a mechanism that cannot measure a heating amount such as a high-frequency oscillator or a heat seal), similarly, when a seal failure occurs, a seal head number cannot be identified among plural seal heads in a sealing device and all the seal heads are checked.

As means for solving the problems in the continuous rotary type filling and packaging machine and the like, there is proposed a container extracting device that selects and extracts a processed container from a container processing line provided with a rotary type container processing device including plural processing heads, the device including recognizing means for recognizing by which processing head the processed container is processed, container discharging means for extracting a predetermined container, inspecting means provided between the container processing device and the container discharging means, printing means for printing, on the extracted container, information identifying the processing head that processes the container, and a control device provided with a shift register that shifts at a timing of the rotary type container processing device rotated at a predetermined angle, wherein, when the inspecting means detects a defective container, the control device writes, in the shift register, information identifying a processing head that processes the defective container and causes the shift register to shift the information and, at the time when the information is shifted to a position of the printing means on the shift register, instructs the printing means to print the information and, at the time when the information is shifted to a position equivalent to the container discharging means, instructs the container discharging means to discharge the container so as to enable identification of a rejected container and a sampling container without manual operation of writing information such as a head number (see for example, Patent Document 3).

However, a continuous rotary type filling and packaging machine having a production ability of 30,000 bottles or more per hour needs to accomplish high-speed and reliable sealing. A problem with a sealing device, especially an ultrasonic sealing device, is that even if a defective seal head can be identified, which part of a seal (horn) working surface in the seal head has a defect cannot be identified, and the seal head in which a seal failure is found must be removed from the sealing device and a cause of the failure must be separately examined. In most cases, it is inevitable to verify whether the defect of the seal (horn) working surface is recovered while the seal head is mounted on the sealing device.

PRIOR ART DOCUMENTS

Patent Documents

Patent Document 1: Japanese Patent Publication No. 49-37977

Patent Document 2: Japanese unexamined Patent Application Publication No. 2005-343508

Patent Document 3: Japanese Patent No. 4258873

SUMMARY OF THE INVENTION

Object to be Solved by the Invention

It is an object of the present invention to provide a high-speed continuous rotary type filling and packaging machine having a production ability of 30,000 bottles or more per hour that, in a sealing device, especially an ultrasonic sealing device, can not only identify a defective filling head and a defective seal head but also identify which part of a seal (horn) working surface in the seal head has a defect and can adjust the defect of sealing while the seal head is mounted on the sealing device.

Means to Solve the Object

As a result of earnestly examining the object in order to solve the object, the present inventors found that, focusing on the fact that, in a sealing device of a high-speed continuous rotary type filling and packaging machine that fills a container body with liquid contents, covers the container body filled with the liquid contents with a disc-like molded lid, and seals the container body and the molded lid to thereby produce a sealed container, a seal working surface in a seal head and the top surface of the container molded lid are in press-contact with each other in a position equivalent to an opening of the container body and a positional relation between the seal working surface and the sealed container is fixed, by inkjet-printing (concealed-printing) a filling head number and a seal head number with invisible ink (transparent ink) or the like, which is readable by irradiation of an ultraviolet ray, on the container body, which is in the state in which the positional relation between the seal working surface and the sealed container is fixed, using printing means provided with an identifying mechanism that can identify by which filling head the sealed container is filled and by which seal head the sealed container is sealed, it is possible to not only identify a filling head that fills a sealed container defective in filling and sealing and a seal head that seals the sealed container but also identify which part of the seal working surface in the seal head has a defect and the present inventors ended in completing the present invention.

The present invention relates to (1) a continuous rotary type filling and packaging machine that fills a container body with liquid contents, covers the container body filled with the liquid contents with a molded lid, and seals the container body and the molded lid to produce a sealed container, the filling and packaging machine including: a filling device provided with a plurality of filling heads for filling a container with the liquid contents while the container body rotationally moves; a lid supplying device that supplies a molded lid to an upper end opening of the container body filled with the liquid contents and conveyed from the filling device; a sealing device provided with a plurality of seal heads that seal the upper end opening of the container body while the container body on which the molded lid is placed rotationally moves with the molded lid to produce the sealed container and a lifting and lowering means including a lifting and lowering mechanism for a container table on which the container body is placed or for the seal head and configured to bring the molded lid on the container body and a seal working surface of the seal head into press-contact with each other; and a printing means provided with an identification printing mechanism that prints a filling head number and a seal head number related to the sealed container on the sealed container body during a sealing step by the sealing device, the sealed container body being in a state in which the seal working surface of the seal head and the top surface of the molded lid of the sealed container are brought into press-contact with each other and a positional relation between the seal working surface and the sealed container is fixed, (2) the continuous rotary type filling and packaging machine according to (1), wherein the printing by the identification printing mechanism is a printing with an invisible ink, (3) the continuous rotary type filling and packaging machine according to (2), wherein the printing means includes an identification printing mechanism including an inkjet printer in which an invisible ink readable by irradiation of an ultraviolet ray is used, (4) the continuous rotary type filling and packaging machine according to in (3), wherein the printing means includes, on an upstream side of the inkjet printer, a water drop removing mechanism for removing a water drop adhered to the container to prevent ink from oozing during printing on a container side circumferential surface, (5) the continuous rotary type filling and packaging machine according to any one of (1) to (4), wherein the identification printing mechanism includes control means includes an calculation unit that calculates a filling head number and a seal head number to be printed on the container, (6) the continuous rotary type filling and packaging machine according to (5), wherein the calculation unit further includes a filling machine control board including a filling head number shift register that stores the filling head number and a seal head number shift register that stores the seal head number, and an inkjet printer control board including a filling head number ring counter that stores the filling head number and a seal head number ring counter that stores the seal head number, (7) the continuous rotary type filling and packaging machine according to any one of (1) to (6), wherein the sealing device is an ultrasonic sealing device that ultrasonically seals the upper end opening of the container body with the molded lid to produce a sealed container, the ultrasonic sealing device including an ultrasonic horn that causes to act an ultrasonic rotational vibration in a rotating direction, of which a central axis is in a pressurizing direction, for pressurizing the molded lid and the container body, to act, and (8) the continuous rotary type filling and packaging machine according to any one of (1) to (7), further comprising on a downstream side of the sealing device: a defective container detecting device disposed; and a defective container discharging device that discharges a container in which a defect is detected from a conveyance line.

The present invention relates to (9) a method for producing a sealed container comprising filling a container body with liquid contents, covering the container body filled with the liquid contents with a molded lid, and sealing the container body and the molded lid by using the continuous rotary type filling and packaging machine according to any one of (1) to (8).

Effect of the Invention

According to the present invention, it is possible to provide a high-speed continuous rotary type filling and packaging machine having a production ability of 30,000 bottles or more per hour that, in a sealing device, especially an ultrasonic sealing device, can not only identify a defective filling head and a defective seal head but also identify which part of a seal (horn) working surface in the seal head has a defect and can adjust the defect of sealing in a state in which the seal head is mounted on the sealing device. Further, when a filling failure or a seal failure occurs, it is possible to support discharge of a defective product from a conveyance lane without conveying the defective product to the next process, immediately check a defective filling head or a defective seal head printed on a discharged container, and identify and repair a defective device and a region of the defective device in a short time.

BRIEF DESCRIPTION OF DRAWINGS

FIG. 1 is a plan view showing an entire embodiment of a continuous rotary type filling and packaging machine according to the present invention.

FIG. 2 is a plan view of a main part of the continuous rotary type filling and packaging machine according to the present invention.

FIG. 3 is a longitudinal sectional view of an ultrasonic sealing device in the continuous rotary type filling and packaging machine according to the present invention.

FIG. 4 is a diagram showing a container subjected to printing processing using the continuous rotary type filling and packaging machine according to the present invention.

MODE OF CARRYING OUT THE INVENTION

A continuous rotary type filling and packaging machine according to the present invention is not specifically limited as long as the continuous rotary type filling and packaging machine is a continuous rotary type filling and packaging machine that fills a container body with liquid contents, covers the container body filled with the liquid contents with a molded lid, and seals the container body and the molded lid to produce a sealed container, the filling and packaging machine including: a filling device provided with a plurality of filling heads for filling a container with the liquid contents while the container body rotationally moves; a lid supplying device that supplies a molded lid to an upper end opening of the container body that is filled with the liquid contents and conveyed from the filling device; a sealing device provided with a plurality of seal heads that seal, while the container body on which the molded lid is placed rotationally moves, the upper end opening of the container body with the molded lid to produce the sealed container and lifting and lowering means including a lifting and lowering mechanism for a container table on which the container body is placed or for the seal head and configured to bring the molded lid on the container body and a seal working surface of the seal head into press-contact with each other; and a printing means provided with an identification printing mechanism that prints a filling head number and a seal head number related to the sealed container on the sealed container body in a sealing process by the sealing device, the sealed container body being in a state in which the seal working surface in the seal head and the top surface of the molded lid of the sealed container are brought into press-contact with each other and a positional relation between the seal working surface and the sealed container is fixed. However, as the ink, invisible ink is particularly desirable. As the liquid contents, milk, juice, lactic acid drink, alcoholic beverage, liquid yoghurt, oil, and the like can be illustrated.

The continuous rotary type filling and packaging machine according to the present invention desirably includes, as explained above, besides the filling device, the lid supplying device, the sealing device, and the printing means, on an upstream side of the filling device, in addition to a container supplying device that supplies a bottomed cylindrical container body made of synthetic resin to the filling device, a lid detecting device disposed on a downstream side of the lid supplying device, a defective container detecting device disposed on the downstream side of the sealing device and for detecting a defective container, and a defective container discharging device that discharges, from a conveyance line, a container in which a defect is detected, a primary lid cold molding device that molds, from a sheet-like lid material, a molded lid made of synthetic resin including a disc-like lid body and a skirt provided to be suspended from the circumferential edge of the lid body and a secondary lid molding device that molds the molded lid of the sealed container molded by the primary lid cold molding device into a final lid shape.

As the container supplying device, a device that can supply the bottomed cylindrical container body made of synthetic resin to the filling device, for example, a well-known container supplying device provided with, for example, a container vertically adjusting device, and a conveyor, a screw conveyor can be used. When such a container supplying device is used, bottle-like containers made of synthetic resin, which are supplied in arbitrary orientations, can be vertically adjusted by the container vertically adjusting device such that upper end openings thereof face up and placed on the conveyor in a row. The containers placed on the conveyor are conveyed to the downstream side and aligned at a predetermined pitch by the screw conveyor in a conveyor downstream section. The aligned containers are supplied to the filling device via an inlet stir wheel.

The filling device is not specifically limited as long as the filling device is a device provided with a plurality of filling heads for filling the container body, which is supplied by the container supplying device, with the liquid contents while the container body rotationally moves. For example, a well-known filling device including a filling liquid tank, a predetermined number of filling nozzles provided on a circumferential edge lower surface of the filling liquid tank at equal intervals to face down, a container placing table provided in a filling nozzle corresponding position below the filling nozzles, and a rotating table to which the container placing table is attached can be used. Above all, for high-speed filling at 33,000 bottles/hour, a vacuum filling device that sets a container in a closed state and fills the container with contents while sucking and removing the air is desirable. When such a filling device is used, the container placing table or the filling nozzles rise and fall and contents can be filled while container on the container placing table rotates.

The sealing device is not specifically limited as long as the sealing device is a sealing device provided with a plurality of seal heads that seal the upper opening of the container body with the molded lid to produce a sealed container while the container body on which the molded lid is placed rotationally moves and lifting and lowering means including a lifting and lowering mechanism for the container table on which the container body is placed and/or the seal head and configured to bring the molded lid on the container body and the seal working surface of the seal head into press-contact with each other. An ultrasonic sealing device and a high-frequency sealing device can be specifically illustrated. An ultrasonic sealing device can be particularly suitably illustrated that ultrasonically seals the upper end opening of the container body with the molded lid to produce a sealed container and includes an ultrasonic horn that causes ultrasonic rotational vibration in a rotating direction, of which a central axis is in a pressurizing direction for pressurizing the molded lid and the container body, to act.

As the lifting and lowering means for the container table in the sealing device, a lifting and lowering means including means that includes a spring for pushing up the container table and brings, during sealing, with an urging force of the spring, the molded lid on the container body and the working surface of the seal head into press-contact with each other is desirable. More specifically, a lifting and lowering means including a placing table fixed to a lower supporting plate and a container table attached above the placing table to be capable of rising and falling can be illustrated. The placing table includes a fixed plate fixed to the lower supporting plate, a guiding cylinder provided above the fixed plate, and a cylindrical bracket provided to be suspended from the fixed plate. The container table includes a container placing plate on which the container is placed, a container holder that is provided on the upper surface of the container placing table and positions the container on the container placing plate, and a cylindrical skirt provided to be suspended from the container placing plate. In the guiding cylinder, a rising and falling body that can slide to be capable of rising and falling in the guiding cylinder is provided. The cylindrical skirt of the container table is provided on the outer surface of the guiding cylinder of the placing table to be capable of sliding. A spring that supports the container table from the lower side is provided between the upper end of the rising and falling body and the lower surface of the container placing table. A long hole is provided in the guiding cylinder of the placing table. A shaft is attached to a position of the rising and falling body corresponding to the long hole. A cam follower is provided at the distal end of the shaft. The cam follower is guided by a cam provided outward the lower supporting plate of the sealing device. The rising and falling body in the guiding cylinder rises and falls according to the operation of the cam follower.

As the lifting and lowering means for the seal head in the sealing device, for example, as described in Japanese Patent Publication No. 5-26006, a lifting and lowering means can be illustrated in which a lifting and lowering cylinder that lowers the seal head and compression-bonds the molded lid to a mouth of the container body and seals the mouth and a lifting switch and lowering switch that actuate the lifting and lowering cylinder are provided and a lifting cam that acts on the lifting switch and lifts the seal head and a lowering cam that acts on the lowering switch and lowers the seal head are provided in a predetermined position to where the seal head rotationally moves.

The printing means is not specifically limited as long as the printing means is a means provided with an identification printing mechanism that prints a filling head number and a seal head number related to the sealed container on the sealed container body during a sealing step by the sealing device while the sealed container body is in a state in which the seal working surface of the seal head and the top surface of the molded lid of the sealed container are brought into press-contact with each other and a positional relation between the seal working surface and the sealed container is fixed. The identification printing mechanism is not specifically limited as long as the identification printing mechanism is a publicly-known printing mechanism that can be usually used for printing of a container of this type. When printing is printing by ink, besides colored inks of black, white, red, blue, yellow, and the like, invisible ink can be illustrated. Above all, an invisible ink is desirable. As such invisible ink, for example, transparent ink that cannot be visually recognized in a normal state under a visible ray and can be visually recognized when a ray having specific wavelength is irradiated can be illustrated. Characters and signs printed with the invisible ink (the transparent ink) using a printing machine such as an inkjet printer is set invisible in the normal state under the visible ray and can be visually recognized by irradiating, for example, an ultraviolet ray when desired. Usually, there is no regularity in the orientation of the container supplied to the sealing device. When visible printing is applied to such a container from a predetermined position, a printing position on the container is indefinite. When decorative printing or the like is applied to the outer circumferential surface of the container, the external appearance of the container is markedly spoiled. Therefore, if the invisible ink is used, it is possible to obtain necessary information when necessary without spoiling the external appearance.

As the printing means, a water drop removing mechanism for removing water drops adhered to the container is desirably provided on the upstream side of the inkjet printer or the like to prevent ink from oozing during printing on a container side circumferential surface. As the water drop removing mechanism, a water drop removing device provided with a hot air blowout hole and a water drop removing device that can bring dried paper or cloth into contact with the container side circumferential surface can be illustrated.

The mechanism that identifies a filling head number and a seal head number related to the sealed container in the identification printing mechanism of the printing means is not specifically limited as long as the mechanism is a mechanism that transmits, to the printing machine, identification information concerning by which filling heads among the plurality of filling heads a container printed by the printing machine is filled with liquid contents and by which seal head among the plurality of seal heads the container is sealed. A publicly-known identification mechanism as well as a mechanism provided with control means including a container detector and a calculation unit can be illustrated.

An identification printing mechanism including control means including a container detecting device provided in a screw conveyor at a pre-stage of an inlet stir wheel disposed upstream of the filling device and an calculation unit that calculates a filling head number and a seal head number to be printed on a container, is explained below.

The screw conveyor is configured to turn once when the filling device and the sealing device move one pitch. A resolver is attached to a shaft of the screw conveyor. A timing signal (a signal of one pulse) can be extracted at an arbitrary set angle in 360° of one turn of the screw conveyor by the resolver.

The filling device includes filling heads respectively having peculiar filling head numbers and a dog that rotates together with the filling heads and is provided in a predetermined position of the filling device. A proximity switch is provided in a position opposed to a rotation track of the dog. The proximity switch detects the dog once while the filling device rotates once. Similarly, the sealing device includes seal heads respectively having peculiar seal head numbers and a dog that rotates together with the seal heads and is provided in a predetermined position of the sealing device. A proximity switch is provided in a position opposed to a rotation track of the dog. The proximity switch detects the dog once while the sealing device rotates once.

The calculation unit of the control means includes a filling machine control board and an inkjet printer control board. The filling machine control board includes a filling head number shift register that stores a filling head number and a seal head number shift register that stores a seal head number. Similarly, the inkjet printer control board includes a filling head number ring counter that stores a filling head number and a seal head number ring counter that stores a seal head number.

When the filling and packaging machine is operated, electric power is input to the filling and packaging machine including the control means. At this point, the filling head number shift register of the filling machine control board does not recognize a filling head number and the position of the filling head and the seal head number shift register does not recognize a seal head number and the position of the seal head.

Subsequently, when the filling and packaging machine is preliminarily operated such that the filling device and the sealing device rotate, the proximity switches of the filling device and the sealing device respectively detect the dogs of the filling device and the sealing device. The dog of the filling head and the dog of the seal head are in a predetermined positional relation. Therefore, the calculation unit calculates a filling head number and the position of the filling head and a seal head number and the position of the seal head at this point and causes the filling head number shift register and the seal head number shift register to respectively recognize the filling head number and the position of the filling head and the seal head number and the position of the seal head.

When filling machine control board recognizes the numbers of the filling head and the seal head and the positions of the filling head and the seal head, the calculation unit calculates a filling head number and a seal head number that the inkjet printer should print on the container and causes the filling head number ring counter and the seal head number ring counter of the inkjet printer control board to recognize the head numbers. When the preparation is complete, the filling and packaging machine changes to a state in which a normal operation is possible.

When the filling and packaging machine changes to the state in which the normal operation is possible, the filling head number and the seal head number recognized by the filling head number ring counter and the seal head number ring counter are counted up by one at a time according to a timing signal extracted from the resolver attached to the shaft of the screw conveyor. In the filling head number ring counter and the seal head number ring counter, numerical values, the number of which is the same as the number of filling heads and the number of seal heads, are set. The filling head number ring counter and the seal head number ring counter repeatedly count the numerical values in order. For example, when the number of filling heads is forty, numerical values from 1 to 40 are set in the filling head number ring counter. The numerical values are counted up in such a manner as 1, 2, . . . , 39, 40, 1, 2, . . . .

When the filling and packaging machine starts the normal operation, a container is conveyed to the screw conveyor. When the container is conveyed to the screw conveyor, a container detector (a photoelectric sensor) of the screw conveyor outputs a signal indicating presence of the container. The container presence signal is accumulated in the filling machine control board like the filling head number and the seal head number. A printing signal is output from the filling machine control board to the inkjet printer control board on the basis of these kinds of information. When the inkjet printer control board receives the printing signal, the inkjet printer prints, on the container, the filling head number and the seal head number recognized by the filling head number ring counter and the seal head number ring counter.

As another method, it is also possible to read, immediately before printing a seal head number, the seal head number with a predetermined reader (reading device) and immediately prints the number with the printing machine. Recognizing means including a calculation unit, a rotary encoder, a sensor, and a dog described in Patent Document 3 can also be used.

When the container is conveyed from the inlet stir wheel, inspection check is executed by a detecting device located in a downstream process of an intermediate stir wheel. When a container whose container body does not have the molded lid placed thereon is detected, the control means causes the defective container discharging device to discharge the container without a lid from a conveyance lane.

Further, when the container is conveyed to the downstream side of a carry-out stir wheel, a manufacturing failure such as a filling failure, a seal failure, or a conveyance failure is detected by the defective container detecting device. The control means causes the defective container removing device to discharge a container determined as a manufacturing failure from the conveyance lane. If the container is not determined as a manufacturing failure, the defective container removing device is not controlled to discharge the container. The container is conveyed to the next process. An ultraviolet ray such as black light is irradiated on the lower side circumferential surface of the discharged defective container, whereby the printed filling head number and seal head number can be read. In the case of a seal failure, it is possible to identify which part of the horn working surface in the seal head has a defect from a positional relation between a seal failure portion and a print. From these results, it is possible to detect a defective device and a defective region early and correct the defective device and the related region of the defective device in a short time.

The continuous rotary type filling and packaging machine according to the present invention is more specifically explained with reference to the accompanying drawings. The technical scope of the present invention is not limited to these illustrations.

In FIG. 1, an overall plan view of a continuous rotary type filling and packaging machine for high-speed filling at 33,000 bottles/hour is shown as an embodiment of the present invention. In FIG. 4, a sealed container A in which an upper end opening of a container body B is sealed by a molded lid P is shown. As shown in FIG. 1, the continuous rotary type filling and packaging machine according to the present invention schematically includes a container supplying device 20 that supplies a bottomed cylindrical container body to a filling device, a filling device 30 that fills the supplied container body with contents, a primary lid cold molding device 50 that molds, from a sheet-like lid material, a molded lid including a disc-like lid body and a skirt provided to be suspended from the circumferential edge of the lid body, a lid supplying device 60 that supplies the molded lid P to an upper end opening of the container body filled with the contents, a lid detecting device 70 disposed on a downstream side of the lid supplying device, a sealing device 100 that seals an upper end opening of the container body B with the molded lid P to produce a sealed container, a container carrying-out device 80 that carries out the sealed container, and a secondary lid molding device 90 that molds the molded lid P of the sealed container molded by the primary lid cold molding device 50 into a final lid shape.

The container supplying device 20 includes a container vertically adjusting device 21, a conveyor 22, and a screw conveyor 23. The container vertically adjusting device 21 vertically adjusts bottle-like bottomed cylindrical container bodies B, which are supplied in arbitrary orientations, such that upper end openings thereof face up and places the bottomed cylindrical container bodies B on the conveyor 22 in a row. The container bodies B placed on the conveyor are conveyed to a downstream side and aligned at a predetermined pitch by the screw conveyor 23 in a conveyor downstream section. The aligned container bodies B are supplied to the filling device 30 via an inlet stir wheel 24. In the filling device 30, liquid contents are filled in a container from forty vacuum filling nozzles (not shown in the figure) while the container rotationally moves in the device. The container filled with the liquid contents is transferred to an intermediate stir wheel 40.

The primary lid cold molding device 50 is provided near the filling device 30. The primary lid cold molding device 50 punches a sheet-like lid material made in a substantially disc shape and molds the punched lid material into a molded lid P consisting of a lid body having a substantially C shape in cross section, i.e., a disc shape and a skirt provided to be suspended from the circumferential edge of the lid body. The molded lid P is laid over the upper end opening of the container body B, which is conveyed by the intermediate stir wheel 40, by the lid supplying device 60. The lid detecting device 70 disposed on the downstream side of the lid supplying device 60 in the intermediate stir wheel 40 detects a container in which the molded lid P is not placed on the container body B.

Subsequently, the container filled with the contents is supplied from the intermediate stir wheel 40 to the sealing device 100. In the sealing device 100, a container that does not have the lid properly placed thereon as determined by the lid detecting device 70 is sealed and hermetically sealed with the molded lid P while the container moves in the sealing device. The container is conveyed to the container carrying-out device 80. A container that does not have the molded lid P placed thereon as determined by the lid detecting device 70 is conveyed to the container carrying-out device 80 in a state in which contact of the molded lid P and a horn 108 is controlled to be prevented.

The container carrying-out device 80 includes a carry-out stir wheel 81, a carry-out conveyor 82, and a screw conveyor 83. Sealed containers are placed on the carry-out conveyor 82 via the carry-out stir wheel 81. The sealed containers placed on the carry-out conveyor 82 are conveyed to the downstream side and aligned at a predetermined pitch by the screw conveyor 83 in a carry-out conveyor downstream section. The aligned sealed containers are supplied to the secondary lid molding device 90 via an inlet stir wheel 91. The secondary lid molding device 90 secondarily molds the molded lid P sealing the container body into a sealed container having a final shape while the sealed container moves in the device. The sealed container having the final shape is conveyed to the next process via an outlet stir wheel 92.

A main part of the devices of the continuous rotary type filling and packaging machine is shown in FIG. 2. A container that does not have the molded lid placed thereon as determined by the lid detecting device 70 shown in FIG. 2 and a container determined as defective by a defective container detecting device 84 are discharged by a defective container removing device 85 placed on the carry-out conveyor 82. The defective container removing device 85 includes container discharging means for blowing away, with an air blow, the container without a lid on the carry-out conveyor 82 to a slide-like shoot beside the conveyor and discharging the container to the outside of the machine with the shoot.

In the screw conveyor 23 at the pre-stage of the inlet stir wheel shown in FIG. 2, a pair of photoelectric sensors 10 are fixedly provided on a plane orthogonal to a container conveying direction and such that a conveyed container blocks a line segment that connects sensor transmitting and receiving units of the pair of photoelectric sensors. Presence or absence of conveyance of a container is checked by the photoelectric sensors 10.

When the screw conveyor 23 rotates a specified number of times, the container is carried into a pocket of the inlet stir wheel 24. Thereafter, the container is conveyed to the filling device 30, the intermediate stir wheel 40, and the sealing device 100 in this order. After water drops adhering to the container are removed at high accuracy by a water drop removing device 111, which is set at a pre-stage of a printing machine (an ink jet printer) 110, to prevent ink from oozing during printing, a filling head number and a seal head number are printed on the lower side circumferential surface of the container with invisible ink as printing W by the printing machine 110 disposed in the sealing device 100. The container with the printing W is carried into the carry-out stir wheel 81. A manufacturing failure is detected by the defective container detecting device 84 disposed on the downstream side of the carry-out stir wheel 81. When a failure is detected, the container in which the failure is detected is discharged from the conveyance line by the defective container discharging device 85.

An ultraviolet ray such as black light is irradiated on the lower side circumferential surface of the discharged container, whereby a filling head number and a seal head number, which are concealed-printed, can be read. In the case of a seal failure, it is possible to identify which part of the horn working surface in the seal head has a defect from a positional relation between a seal failure portion and a print.

A relation between the printing machine 110 and a seal position is described with reference to an overall sectional view of the sealing device 100 shown in FIG. 3. The sealing device 100 includes an upper supporting plate 102, in the circumferential edge of which thirty ultrasonic welding machines 101 are fixedly provided at equal intervals, and a lower supporting plate 104, on which thirty container tables 103 are fixedly provided in opposed positions below the ultrasonic welding machines. The upper supporting plate 102 and the lower supporting plate 104 are fixed to a driving shaft 105 of the sealing device. A control device 106 of the sealing device is provided above the respective welding machines. The ultrasonic welding machine 101 consists of a welding machine body 107 fixedly provided in the upper supporting plate 102 and a round bar-like horn 108 projecting downward from the welding machine body 107 and having a seal working surface at the lower end. According to the rising of the container table 103 attached to the lower supporting plate 104 via the placing table, at a top dead point of the container table 103, the upper end of a container placed on the container table 103 is pressed against the horn 108 via the molded lid P laid over the container. A working surface of the horn and the top surface of the container molded lid P are brought into press-contact with each other in a position equivalent to the opening of the container body B. A positional relation between the working surface of the horn and the sealed container A is fixed.

The printing machine 110 is set on a slightly downstream side of the sealing device 100, which is in a state in which the molded lid P on the container body and the working surface of the horn 108 are in press-contact with each other, such that a jetting direction of ink has a fixed angle of skew with respect to the lower side circumferential surface of the container to enable nozzles of the printing machine 110 to perform the printing W of a filling head number and a seal head number on the lower side circumferential surface of the container as shown in FIG. 4.

EXPLANATION OF LETTERS AND NUMERALS

10 pair of photoelectric sensors; container detecting device (photoelectric switch)
20 container supplying device
21 container vertically adjusting device
22 conveyor
23 screw conveyor
24 inlet stir wheel
30 filling device
40 intermediate stir wheel
50 primary lid cold molding device
60 lid supplying device
70 lid detecting device
80 container carrying-out device
81 carry-out stir wheel
82 carry-out conveyor
83 screw conveyor
84 defective container detecting device
85 defective container removing device

90 secondary lid molding device
91 inlet stir wheel
92 outlet stir wheel
100 sealing device
101 ultrasonic welding machine
102 upper supporting plate
103 container table
104 lower supporting plate
105 driving shaft
106 control device
107 welding machine body
108 horn
110 printing machine (inkjet printer)
111 water drop removing device
P molded lid
A sealed container
B container body
W printing

The invention claimed is:

1. A continuous rotary type filling and packaging machine that fills a container body with liquid contents, covers the container body filled with the liquid contents with a molded lid, and seals the container body and the molded lid to produce a sealed container, the filling and packaging machine comprising:

a filling device provided with a plurality of filling heads for filling a container with the liquid contents while the container body rotationally moves;

a lid supplying device that supplies the molded lid to an upper end opening of the container body filled with the liquid contents and conveyed from the filling device;

a sealing device provided with a plurality of seal heads that seal the upper end opening of the container body while the container body on which the molded lid is placed rotationally moves with the molded lid to produce the sealed container, and a lifting and lowering means including a lifting and lowering mechanism for a container table on which the container body is placed or for the seal head, and configured to bring the molded lid on the container body and a seal working surface of the seal head into press-contact with each other; and a printing means provided with an identification printing mechanism that prints a filling head number and a seal head number related to the sealed container on all of the sealed container bodies during a sealing step by the sealing device while the sealed container body is in a state in which the seal working surface of the seal head and a top surface of the molded lid of the sealed container are brought into press-contact with each other and a positional relation between the seal working surface and the sealed container is fixed, wherein the identification printing mechanism includes a control means including a calculation unit that calculates the filling head number and the seal head number to be printed on the container, wherein the calculation unit further includes a filling machine control board including a filling head number shift register that stores the filling head number and a seal head number shift register that stores the seal head number, and an inkjet printer control board including a filling head number ring counter that stores the filling head number and a seal head number ring counter that stores the seal head number, and wherein the filling head number and the seal head number are printed on a lower side circumferential surface of the container.

2. The continuous rotary type filling and packaging machine according to claim 1, wherein the printing by the identification printing mechanism is a printing with an invisible ink.

3. The continuous rotary type filling and packaging machine according to claim 2, wherein the printing means includes the identification printing mechanism including an inkjet printer in which an invisible ink readable by irradiation of an ultraviolet ray is used.

4. The continuous rotary type filling and packaging machine according to claim 3, wherein the printing means includes, on an upstream side of the inkjet printer, a water drop removing mechanism for removing a water drop adhered to the container to prevent ink from oozing during printing on a side circumferential surface of the container.

5. The continuous rotary type filling and packaging machine according to claim 1, wherein the sealing device is an ultrasonic sealing device that ultrasonically seals the upper end opening of the container body with the molded lid to produce the sealed container, the ultrasonic sealing device including an ultrasonic horn that causes to act an ultrasonic rotational vibration in a rotating direction, of which a central axis is in a pressurizing direction, for pressurizing the molded lid and the container body.

6. The continuous rotary type filling and packaging machine according to claim 1, comprising on a downstream side of the sealing device:

a defective container-detecting device disposed to detect a defective container; and a defective container-discharging device that discharges a container in which a defect is detected from a conveyance line.

7. A method for producing a sealed container comprising filling a container body with liquid contents, covering the container body filled with the liquid contents with a molded lid, and sealing the container body and the molded lid by using the continuous rotary type filling and packaging machine according to claim 1.

* * * * *